US005080601A

United States Patent [19]

Mennekes et al.

[11] Patent Number: 5,080,601

[45] Date of Patent: Jan. 14, 1992

[54] APPLIANCE PLUG

[75] Inventors: Dieter Mennekes, In der Deutmecke; Walter Mennekes, Am Krähenberg, both of Fed. Rep. of Germany

[73] Assignee: Aloys Mennekes Anlagengesellschaft

[21] Appl. No.: 657,107

[22] Filed: Feb. 15, 1991

[30] Foreign Application Priority Data

Jan. 18, 1991 [DE] Fed. Rep. of Germany ..... 4101316

[51] Int. Cl.[5] ..... H01R 4/54

[52] U.S. Cl. ..... 439/314; 439/271; 439/277

[58] Field of Search ..... 439/311, 314, 316, 318, 439/319, 271, 277, 283, 686, 689, 690

[56] References Cited

U.S. PATENT DOCUMENTS 3,430,187 2/1969 Man et al. ..... 439/277
3,538,485 11/1970 Hennessey, Jr. ..... 439/314
4,553,806 11/1985 Forhey, Jr. et al. ..... 439/277

FOREIGN PATENT DOCUMENTS 1314138 11/1962 France ..... 439/271

*Primary Examiner*—Larry I. Schwartz

*Assistant Examiner*—Hien P. Vu

*Attorney, Agent, or Firm*—Toren, McGeady & Associates

[57] ABSTRACT

An appliance plug includes a front housing part with a collar having a sealing flange and a contact carrier member and a cover plate for contact pins surrounded by the collar and including fastening screws mounted in the contact carrier member. A rear housing part includes a support flange which is engaged from behind by a bayonet ring, and screw columns for the fastening screws in the contact carrier member and a cable insertion member. The end face of the sealing flange is provided with an annular groove and a sealing ring inserted into the annular groove. The rear housing part has a sealing edge which can be pressed into the annular groove or the sealing ring. The collar has an internal flange serving as a support for the contact carrier members and as an abutment for the cover plate. The contact carrier member has locking projections and the cover plate has locking recesses which are engaged by the locking projections. The individual components of the front housing part can be assembled without screws. In addition, the front housing part can be used for other types of plugs.

7 Claims, 3 Drawing Sheets

APPLIANCE PLUG

BACKGROUND OF THE INVENTION

1. Field of the Invention

The present invention relates to an appliance plug, particularly a splash-proof and water-tight plug with shrouded contacts as described in German Industrial Standards DIN 49462/63/65. The appliance plug is composed of a front housing part including a collar with sealing flange and including a contact carrier member and a cover plate for contact pins surrounded by the collar and including fastening screws in the contact carrier member. The appliance plug is further composed of a rear housing part including a support flange which is engaged from behind by a bayonet ring and including screw columns for the fastening screws in the contact carrier member and including a cable insertion member.

2. Description of the Related Art

An appliance plug of the above-described type is known, for example, from German Utility Model 86 05 972.6. In the known appliance plug, the contact carrier member is constructed in one piece with the collar of the front housing part or is fastened as a structural unit in the collar. The collar has a circumferentially extending web with a sealing ring. The actual sealing flange is provided on the rear housing part. The front housing part is fastened in the rear housing part in such a way that the collar projects into the interior space of the rear housing part defined by the sealing flange. The collar may rest with its outer surface against the inner surface of the sealing flange and of the sealing ring resting on the sealing flange. Thus, it is necessary to provide a press fit between the front housing part and the rear housing part which is complicated with respect to manufacture of the plug, on the one hand, and practically excludes the use of the front housing part for other appliance plugs, on the other hand. In addition, the bayonet ring must be slid on from the cable insertion side.

SUMMARY OF THE INVENTION

It is, therefore, the object of the present invention to provide an appliance plug, particularly a splash-proof or water-tight plug with shrouded contacts in accordance with German Industrial Standards DIN 49462/63/65 of the above-described type, in which the assembly of front housing part and rear housing part is easier and the wiring is simplified, wherein the front housing part can also be used for appliance plugs of different types, such as, wall plugs, base-mounted plugs or plugs for mounted implements.

In accordance with the present invention, the above object is met in a appliance plug of the above-described type by providing the end face of the sealing flange with an annular groove and a sealing ring inserted in the annular groove. In addition, the rear housing part has an end face with a sealing edge, wherein the rear housing part can be pressed with the sealing edge into the annular groove or the sealing ring. The collar has in the region of the contact carrier member an internal flange serving as a support for the contact carrier member and as an abutment for the cover plate. The contact carrier member has axially extending locking projections and the cover plate has locking recesses, wherein the locking projections engage in the locking recesses.

The features of the present invention make it unnecessary to provide a sealing flange on the rear housing part. Moreover, the front housing part is composed of individual components, such as collar with sealing flange, contact carrier member and cover plate, wherein these individual components can be easily connected to each other without requiring screw connections for safe operation, so that assembly and disassembly of the front housing part itself and also in connection with the rear housing part can be carried out in a simple manner. Consequently, wiring also poses no difficulties. Moreover, since the front housing part is an independent structural component with sealing flange, the front housing part can be used for other purposes, for example, for a wall plug, base-mounted plug or a plug for mounted implements. After the front housing part and the rear housing part have been screwed together by means of the fastening screws, the locking projections in the front housing part which connect the collar, the contact carrier member and the cover plate with each other still serve a functional purpose, but no loads act on the locking projections.

In accordance with another important feature of the present invention, the sealing flange has a greater outer diameter than the support flange on the rear housing part and consequently, has a greater diameter than the rear housing part, and the sealing flange rests against the support flange when the housing parts are joined together. In accordance with another advantageous feature, the cover plate has a locking ring with the locking recesses resting against the internal flange of the collar, wherein the contact carrier member has at least two oppositely located locking projections and the cover plate or the locking ring has two corresponding oppositely located locking recesses. It is also within the scope of the invention to provide more than two locking projections and locking recesses.

When the housing parts of the plug are screwed together, the contact carrier member which presses against the internal flange of the collar rests against the screw columns, while the rear housing part has in its interior space support ribs for the cover plate, so that the cover plate rests against the support ribs.

As is well known, the bayonet ring serves to realize a bayonet connection and, for this purpose, interacts with a bayonet flange on the opposite piece to be connected, for example, a socket. In accordance with the present invention, the bayonet ring can be snapped with its inner edge over the support flange onto the rear housing part. In addition, the rear housing part has axially extending guide ribs and a stop flange for the bayonet ring. The bayonet ring has at its inner edge oppositely located pairs of ramps whose inner diameter corresponds to the outer diameter of the rear housing part, while providing a predetermined play. The guide ribs engage with predetermined play in guide recesses formed between the ramps which are arranged in pairs. When the bayonet ring is pulled, the ramps move past the guide ribs in screwing direction.

In this water-tight embodiment of the appliance plug, the bayonet ring no longer has to be mounted from the side of the cable insertion. Rather, the bayonet ring can also be pressed in the manner of a clip onto the rear housing part after the cable connection has been made. The bayonet ring is always maintained by the guide ribs in an exact unlocked position, so that the appliance plug according to the present invention can be inserted and pulled without impairment. The bayonet ring is freely movable in axial direction on the guide ribs without losing the positioning in the unlocked position. Only when the bayonet ring is pulled and, consequently, when the bayonet connection is effected, the ramps move past the guide ribs in screwing direction.

In accordance with a preferred feature, the flange-like inner edge of the bayonet ring has on the inside radially extending ribs which rest against the sealing flange at the collar of the front housing part when the bayonet ring is tightened. The thickness of the ribs is dimensioned accordingly for this purpose. The front housing part and the rear housing part, the sealing flange and the bayonet ring, and the contact carrier member and the cover plate are always properly supported and sealed in a positively locking and frictionally engaging manner.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
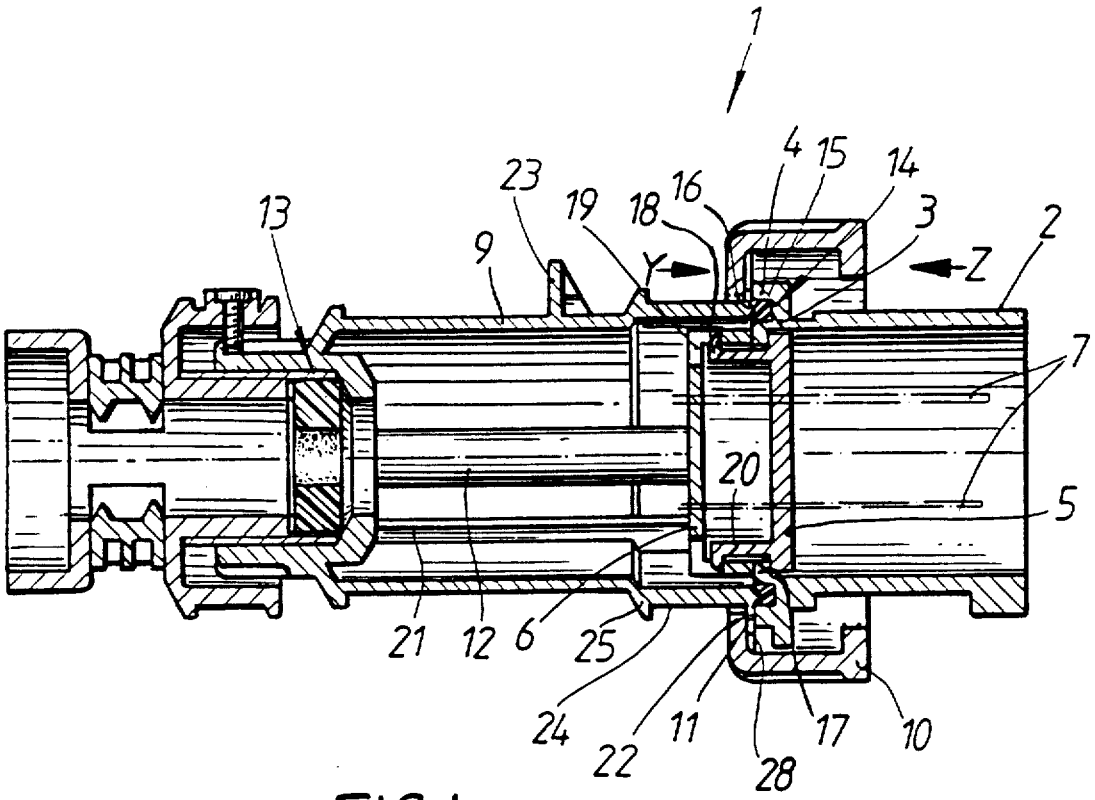
FIG. 1 is an axial sectional view of an appliance plug according to the present invention.
Figure 2:
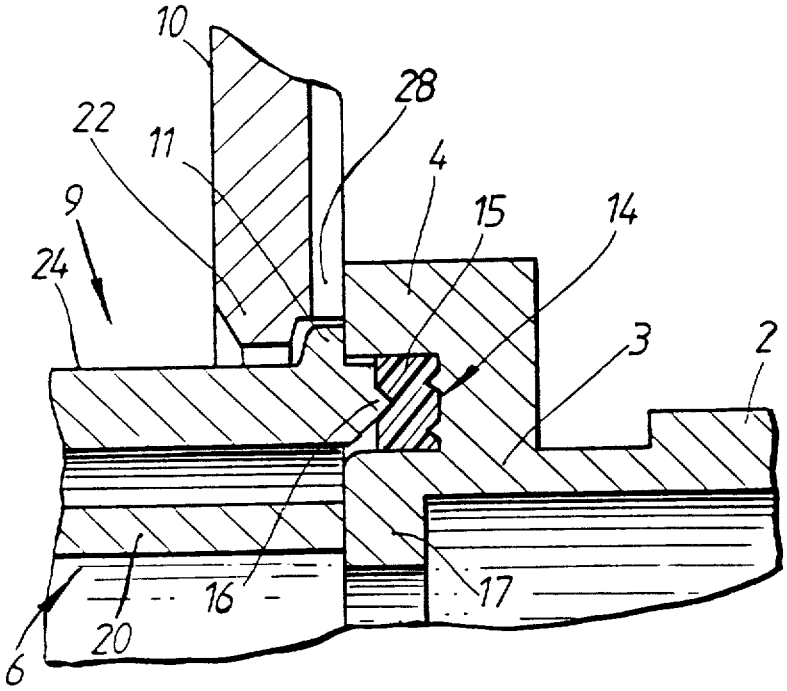
FIG. 2 shows a detail, on a larger scale, of the plug of FIG. 1 in the connection area between front housing part and rear housing part.
Figure 3:
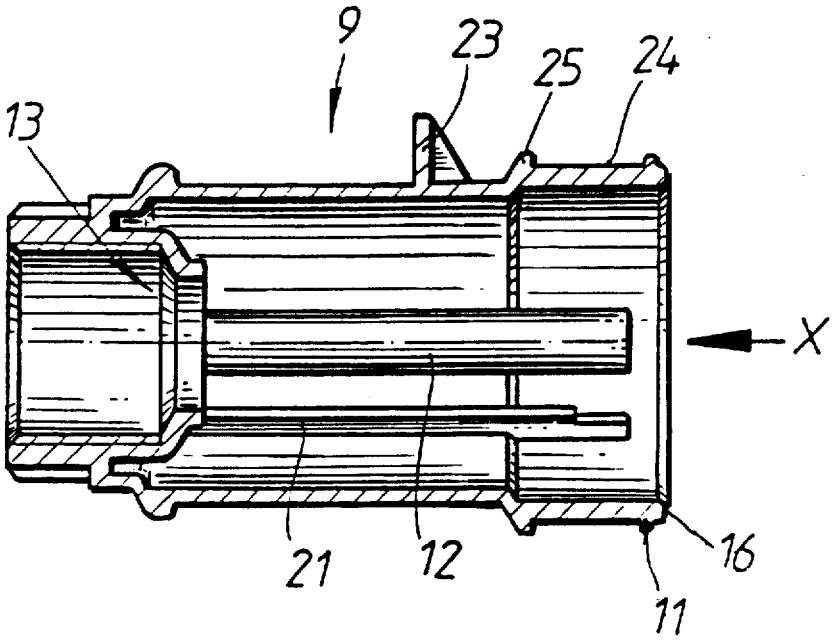
FIG. 3 shows a detail of the plug of FIG. 1 in the area of the rear housing part.
Figure 4:
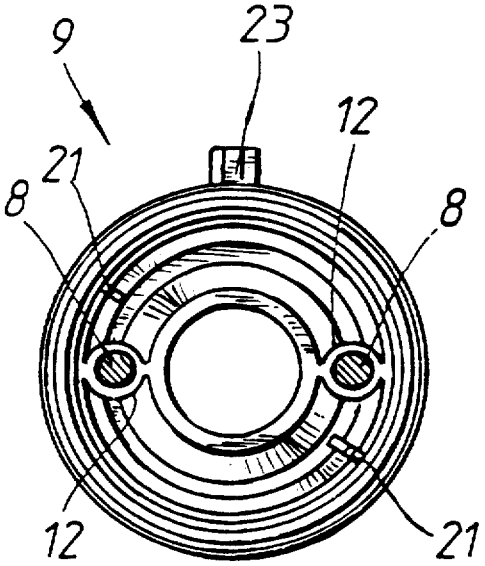
FIG. 4 is a schematic view of the rear housing part of FIG. 3 with fastening screws, seen in the direction of arrow X of FIG. 3.
Figure 5:
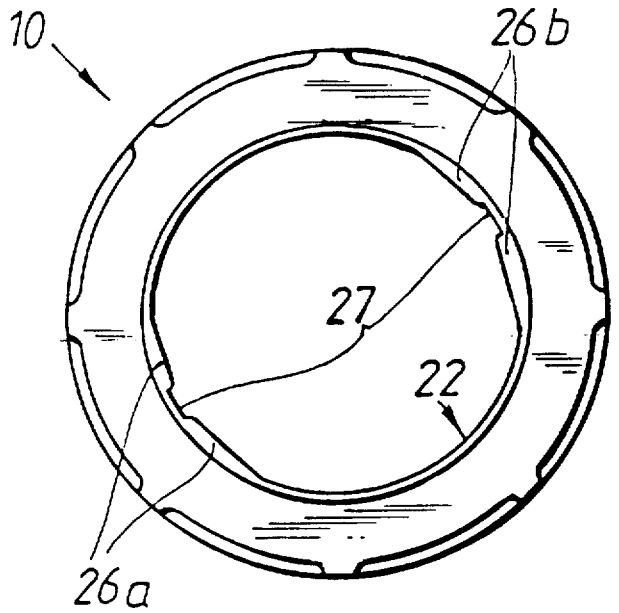
FIG. 5 is a view of the bayonet ring of the plug of FIG. 1 seen in the direction of arrow Y.
Figure 6:
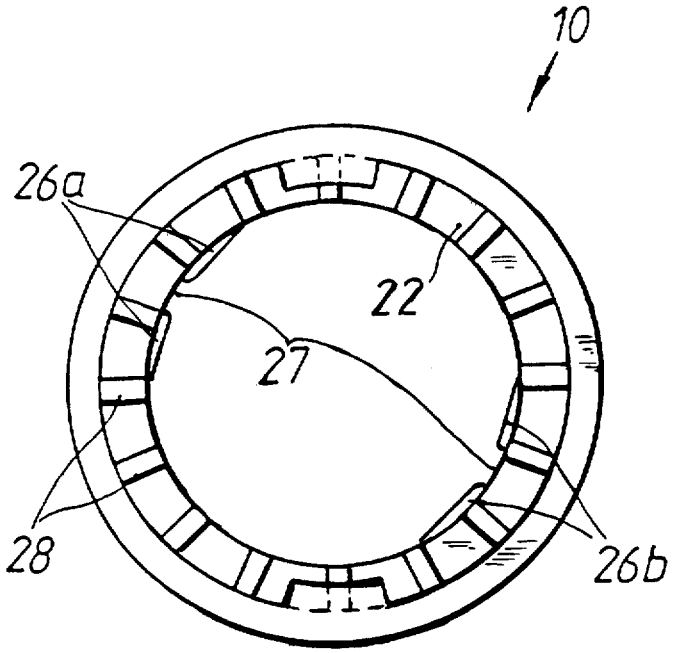
FIG. 6 is a view of the plug of FIG. 5 seen in the direction of arrow Z.

The figures of the drawing show an appliance plug 1 constructed as a splash-proof and water-tight plug with shrouded contact according to German Industrial Standards DIN 49462/63/65 of insulating material or an insulating plastics material. The appliance plug 1 is basically constructed of a front housing part 2 with a collar 3 with a sealing flange 4 and with a contact carrier member 5 and with a cover plate 6 for contact pins 7 which are surrounded by the collar 3. Fastening screws 8 extend through the contact carrier member 5. The plug 1 further includes a rear housing part 9 with a support flange 11 which is engaged from behind by a bayonet ring 10, with screw columns 12 for the fastening screws 8 in the contact carrier member 5 and with a cable insertion member 13 which may be water-tight. The sealing flange 4 has in its end face an annular groove 14 with a sealing ring 15 being placed in the annular groove.

The rear housing part 9 has at its end face a sealing edge 16 and can be pressed with the sealing edge into the annular groove 14 or the sealing ring 15 to obtain a sealing effect. The collar 3 has in the region of the contact carrier member 5 an internal flange 17 which serves as a support for the contact carrier member 5 and as an abutment for the cover plate 6.

The contact carrier member 5 has axially extending locking projections 18 and the cover plate 6 has corresponding locking recesses 19 for engagement of the locking projections 18. The sealing flange 4 has a greater outer diameter than the support flange 11 on the rear housing part 9 and, consequently, a greater outer diameter than the rear housing part 9. When the housing parts 2, 9 are joined together, the sealing flange 4 rests against the support flange 11. The cover plate 6 has a locking ring 20 with the locking recesses 19 which locking ring 20 rests against the internal flange 17 of the collar 3. The contact carrier member 5 has at least two oppositely located locking projections 18 and the cover plate 6 has locking recesses 19 which are positioned corresponding to the locking projections 18. The rear housing part 9 has in its interior support ribs 21 for the cover plate 6, while the contact carrier member 5 is supported on the screw column 12 when the front housing part 2 and the rear housing part 8 are joined together.

The bayonet ring 10 can be slid in the manner of a snap or a clip with its inner edge 22 over the support flange 11 onto the rear housing part 9. Accordingly, the bayonet ring 10 can be mounted subsequently onto the rear housing part 9 from the side which is located opposite the cable insertion side. In addition, this makes it unnecessary to slide the bayonet ring 10 over the support projection 23 which is usually arranged on the rear housing part 9 for a locking connection of the appliance plug 1 with a socket in the assembled state. As a result, the bayonet ring 10 no longer has to have an appropriate recess which would weaken its stability and make its assembly more difficult because it would first be necessary to look for the correct position of the recess relative to the support projection.

The rear housing part 9 has axially extending guide ribs 24 and a stop flange 25 for the bayonet ring 10. The bayonet ring 10 has at its inner edge 22 oppositely located pairs of ramps **26*a*, 26*b*, whose inner diameter corresponds to the outer diameter of the rear housing part 9 while providing an appropriate play. The guide ribs 24 engage in guide recesses 27 with a predetermined play between the ramps 26*a*, 26*b* which are arranged in pairs and the ramps can move past the guide ribs 24 when the bayonet ring 10 is tightened in screwing direction. The flange-like inner edge 22 of the bayonet ring 10 has inner radially extending ribs 28 which rest against the sealing flange 4 on the collar 3 of the front housing part 2 when the bayonet ring 10** is tightened.

While a specific embodiment of the invention has been shown and described in detail to illustrate the application of the inventive principle, it will be understood that the invention may be embodied otherwise without departing from such principles.

We claim

1. In a flash-proof and water-tight appliance plug, the appliance plug including a front housing part and a rear housing part, the front housing part having an end facing the rear housing part, the front housing part having at the end thereof a collar with a sealing flange and a contact carrier member and having a cover plate for contact pins surrounded by the collar and fastening screws mounted in the contact carrier member, the rear housing part having an end facing the front housing part, the rear housing part having at the end thereof a support flange, a bayonet ring engaging the support flange on a side of the support flange remote from the end of the rear housing part, the rear housing part further including screw columns for the fastening screws in the contact carrier member and a cable insertion member, the improvement comprising the sealing flange having an end face, the end face of the sealing flange having an annular groove and a sealing ring inserted in the annular groove, the rear housing part having at the end thereof a sealing edge, such that the rear housing part can be pressed with the sealing edge into the annular groove and the sealing ring, the collar having an internal flange serving as a support for the contact carrier member and as an abutment for the cover plate, and wherein the contact carrier member has locking projections and the cover plate has locking recesses, the locking projections engaging in the locking recesses.

2. The appliance plug according to claim 1, wherein the sealing flange has a greater outer diameter than the support flange on the rear housing part, and wherein the sealing flange rests against the support flange when the front housing part and the rear housing part are joined together.

3. The appliance plug according to claim 1, wherein the cover plate includes a locking ring, the locking recesses being provided in the locking ring, and wherein the locking ring rests against the internal flange of the collar.

4. The appliance plug according to claim 1, wherein the contact carrier member has at least two oppositely located locking projections and the cover plate has corresponding locking recesses.

5. The appliance plug according to claim 1, wherein the rear housing part has in the interior thereof support ribs for the cover plate.

6. The appliance plug according to claim 1, wherein the bayonet ring has an inner edge, the bayonet ring being slidable with the inner edge past the support flange onto the rear housing part, the rear housing part having axially extending guide ribs and a stop flange for the bayonet ring, the bayonet ring having at the inner edge oppositely located pairs of ramps, the pairs of ramps having an inner diameter which corresponds to the outer diameter of the rear housing part, and wherein the guide ribs engage with predetermined play in guide recesses formed between the ramps, and wherein the ramps can slide over the guide ribs when the bayonet ring is mounted on the rear housing part.

7. The appliance plug according to claim 6, wherein the inner edge of the bayonet ring has radially extending ribs which rest against the sealing flange on the collar of the front housing part when the bayonet ring is mounted on the rear housing part.

* * * * *

UNITED STATES PATENT AND TRADEMARK OFFICE

CERTIFICATE OF CORRECTION

PATENT NO. : 5,080,601

DATED : 14 Janaury 1992

INVENTOR(S) : Dieter Mennekes et al.

It is certified that error appears in the above-identified patent and that said Letters Patent is hereby corrected as shown below:

Title page, Assignee should read as follows:

Item (73) Assignee: Aloys Mennekes Anlagengesellschaft, Kirchhundem, Federal Republic of Germany Signed and Sealed this Sixth Day of July, 1993

*Attest:*

Michael K. Kirk

MICHAEL K. KIRK

*Attesting Officer*

*Acting Commissioner of Patents and Trademarks*